US005485985A

United States Patent [19]

Eppeland et al.

[11] Patent Number: 5,485,985

[45] Date of Patent: Jan. 23, 1996

[54] METHOD AND APPARATUS FOR HEAT TREATING

[75] Inventors: John R. Eppeland, St. James; Jack E. Mannerud, Coon Rapids, both of Minn.

[73] Assignee: BGK Finishing Systems, Inc., Blaine, Minn.

[21] Appl. No.: 187,612

[22] Filed: Jan. 27, 1994

Related U.S. Application Data

[62] Division of Ser. No. 59,191, May 6, 1993, Pat. No. 5,306,359, which is a continuation of Ser. No. 824,378, Jan. 23, 1992, abandoned, which is a continuation-in-part of Ser. No. 788,252, Nov. 5, 1991, abandoned.

[51] Int. Cl.[6] ..... C21D 11/00

[52] U.S. Cl. ..... 266/87; 266/96; 266/99; 266/128; 266/130; 374/153; 392/416

[58] Field of Search ..... 266/87, 96, 99, 266/128, 130; 374/153; 392/416

[56] References Cited

U.S. PATENT DOCUMENTS

| | | | |
|---|---|---|---|
| 3,496,033 | 2/1970 | Gilbreath, Jr. et al. | 266/87 |
| 3,748,425 | 7/1973 | Potter | 266/87 |
| 4,229,236 | 10/1980 | Heath | 374/153 |
| 5,050,232 | 9/1991 | Bergman et al. | 392/412 |
| 5,306,359 | 4/1994 | Eppeland et al. | 148/511 |
| 5,336,344 | 8/1994 | Wei | 148/549 |
| 5,340,418 | 8/1994 | Wei | 148/549 |

OTHER PUBLICATIONS

Military Specification MIL-H-6088F, effective Jul. 21, 1981 and entitled Heat Treatment of Aluminum Alloys, pp. 1–51.

Metals Handbook, vol. 4, American Society for Metals (1981), pp. 675–718.

Society of Automotive Engineers, Inc., Aerospace Material Specification 2771, issued Oct. 1, 1987 and entitled Heat Treatment of Aluminum Alloy Castings, pp. 1–12.

Society of Automotive Engineers, Inc., Aerospace Material Specification 2770E, issued Jan. 1, 1989 and entitled Heat Treatment of Wrought Aluminum Alloy Parts, pp. 1 and 4–20.

*Primary Examiner*—David A. Simmons
*Assistant Examiner*—Robert R. Koehler
*Attorney, Agent, or Firm*—Merchant, Gould, Smith, Edell, Welter & Schmidt

[57] ABSTRACT

An apparatus for metallurgically heat treating a plurality of discrete individually movable aluminum alloy parts includes a plurality of successive stations for heat treating the parts. The plurality of stations are arranged in a line of travel. Infrared radiation lamps are provided at each station. A conveyor mechanism places and holds a part in a station for heat treatment. The conveyor moves the part to a subsequent station for further heat treatment. The conveyor mechanism holds the part stationary relative to the line of travel while the part is in a station being heat treated.

30 Claims, 4 Drawing Sheets

METHOD AND APPARATUS FOR HEAT TREATING

This application is a divisional application of Ser. No. 08/059,191 (now U.S. Pat. NO. 5,306,359) filed on May 6, 1993 which is a continuation of Ser. No. 07/824,378 filed Jan. 23, 1992 (now abandoned) which is continuation-in-part of Ser. No. 07/788,252 filed Nov. 5, 1991 (now abandoned). Priority of filing date is hereby claimed to the filing dates of each of those applications.

BACKGROUND OF THE INVENTION

1. Field of the Invention

This invention pertains to heat treatment. More particularly, this invention pertains to heat treatment of aluminum or aluminum alloy parts utilizing direct infrared radiation as the heat source.

2. Description of the Prior Art

After casting an aluminum or an aluminum alloy part, it is often desirable to heat treat the part to achieve improved mechanical properties. For example, heat treatment may achieve a desired hardness to facilitate machining of the part.

A common heat treatment technique involves heating the aluminum part to about 1000° F. then rapidly cooling the part. The cooling (or quenching) is followed by an aging process to stabilize the metallurgy of the part. A typical aging would involve heating the part to 300° or 500° F. and maintaining the part at that temperature for a period of time. By way of example, the Aerospace Material Specification AMS 2771 of the Society of Automotive Engineers issued Oct. 1, 1987, and entitled *Heat Treatment of Aluminum Alloy Castings*, shows heat treating aluminum alloy 356 at a temperature of 1000° F. for six hours before quenching (AMS 2771, p. 10). Following quenching, AMS 2771 recommends soaking the cast part at 440° F. for as much as six to twelve hours (AMS 2771, p. 11).

Recommended prior art procedures for wrought aluminum alloy parts are found in AMS 2770E as revised Jan. 1, 1989. Similarly, military specification MIL-H-6088F, effective Jul. 21, 1981, and entitled *Heat Treatment of Aluminum Alloys,* calls for aging 356 aluminum alloy at one to six hours at temperatures of 300° to 320° F. (see, MIL-H-6088F, p. 34). The ASM Committee on Heat Treatment of Aluminum Alloys suggests a treatment time of four to twelve hours at 1000° F. for 356 aluminum alloy followed by an aging of three to nine hours at an aging temperature of 310°–475° F. (See page 685 of Metals Handbook, 9th Ed., Vol. 4, American Society for Metals (1981).

As is apparent from the foregoing, the heat treatment and aging of aluminum alloys is extremely time consuming. Furthermore, such heat treatment generally is attained in a batch process. For example, a plurality of aluminum castings are placed on a pallet or other device in a common oven and heat treated or aged as a collective group. Accordingly, there may be variations among the various castings of the batch. As a result, certain castings in the batch may not be suitably heat treated and may be subject to rejection.

It is an object of the present invention to provide a method and apparatus for reducing the required time for heat treatment of aluminum alloys. Further, it is an object of the present invention to provide a mechanism which is susceptible for use for individually heat treating a part. By individually heat treating a part, separate metallurgical records can be retained as to any given part. It is believed that in addition to having separate metallurgical records, the individual heat treatment will result in reduced scrap or waste associated with batch processing.

SUMMARY OF THE INVENTION

According to a preferred embodiment of the present invention, a method and apparatus is provided for heat treating an aluminum alloy part. The part is heat treated by radiation applied directly from a source of infrared energy until the part attains a desired state of heat treatment. During the heat treating, the temperature of the part is monitored and the intensity of the radiation source is proportionately controlled in response to the monitored temperature.

DESCRIPTION OF THE PREFERRED EMBODIMENT

Referring now to several drawing Figures in which identical elements are numbered identically throughout, an apparatus 10 is shown for heat treating an aluminum alloy product 12. For purposes of this description and the appended claims, the term "aluminum alloy" means aluminum and aluminum based products. The term shall include both cast, wrought, extruded or otherwise formed products.

In the following examples, the product 12 is shown as a common automobile wheel which is cast from aluminum 356 alloy. The temperatures and times illustrated herein apply to such a part. It will be appreciated by those skilled in the art that the present invention can be equally applied to any aluminum based alloy-and need not necessarily be limited to aluminum 356. Further, it will be appreciated by those skilled in the art that the apparatus and method disclosed herein can be utilized in a wide variety of aluminum parts.

Figure 1:
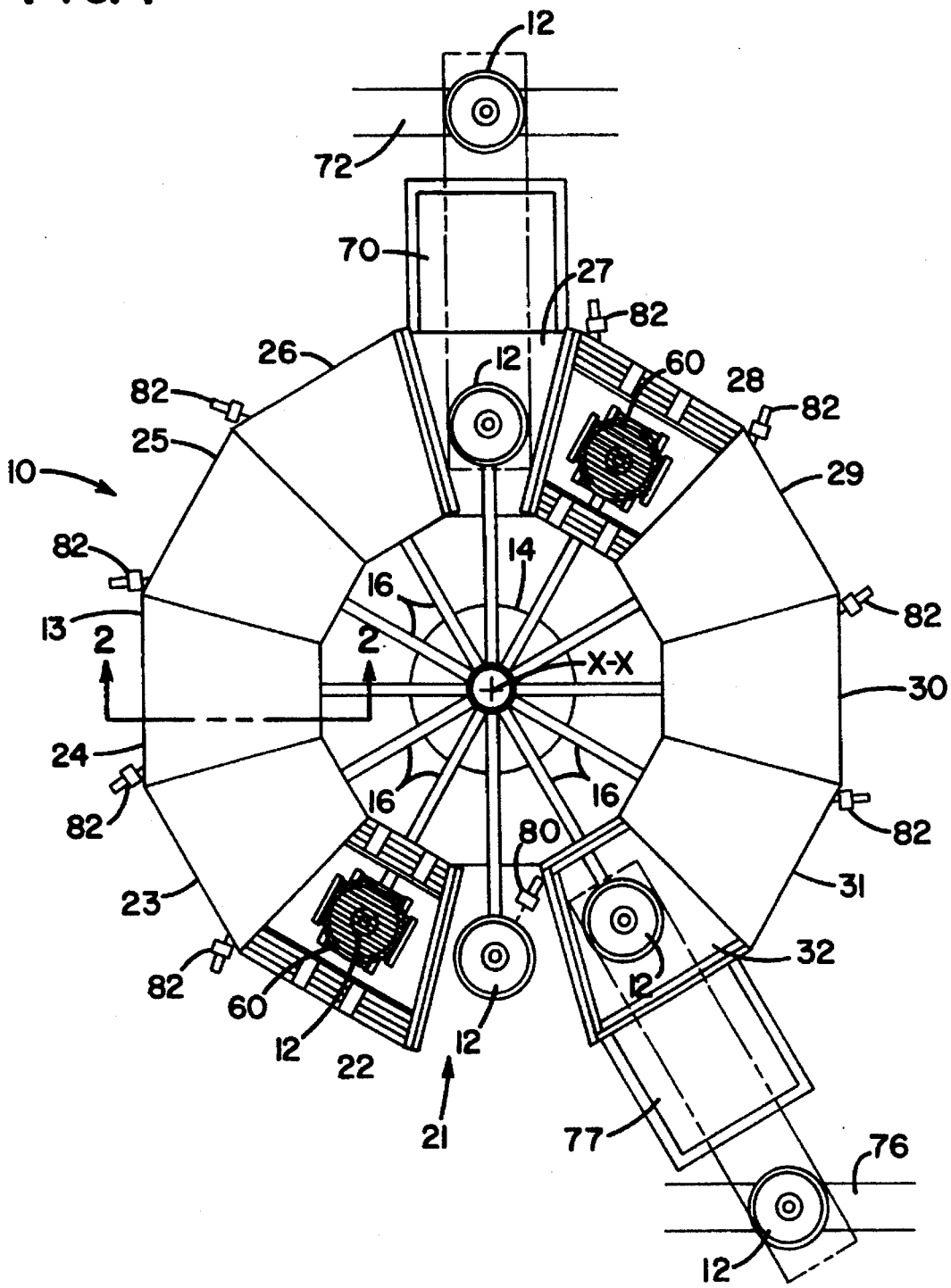
FIG. 1 is a top plan view of an apparatus for heat treating an aluminum part.

As best shown in FIG. 1, the apparatus 10 is in the form of a generally circular carousel 13, having a plurality of stations 21–32. Shown in FIG. 1, carousel 13 is a dodecagon with twelve stations 21–32, arranged in a contiguous manner around the periphery of carousel 13. Stations 22–26 and 28–31 are heating stations. Station 21 is a load station, station 32 is an unload station, and station 27 is a transfer station (all of which will be described).

The apparatus 10 includes an indexing drive 14 centrally disposed within the carousel 13. An indexing motor (not shown) rotates drive 14 about its axis X—X.

Radiating out from indexing drive 14 are a Plurality of indexing arms 16 (one for each station 21–32). Arms 16 are secured to indexing drive 14 such that as drive 14 rotates about its central axis X—X, the arms 16 rotate throughout the carousel 13. Each of the arms 16 is horizontal. A terminal end of the arm 16 supports a main spindle 18 on which the part 12 is positioned (see FIG. 2). Spindle 18 is pivotally connected to arm 16 such that spindle 18 may be driven about its axis Y—Y to rotate the part 12 about its axis as arms 16 rotate about axis X—X.

Figure 2:
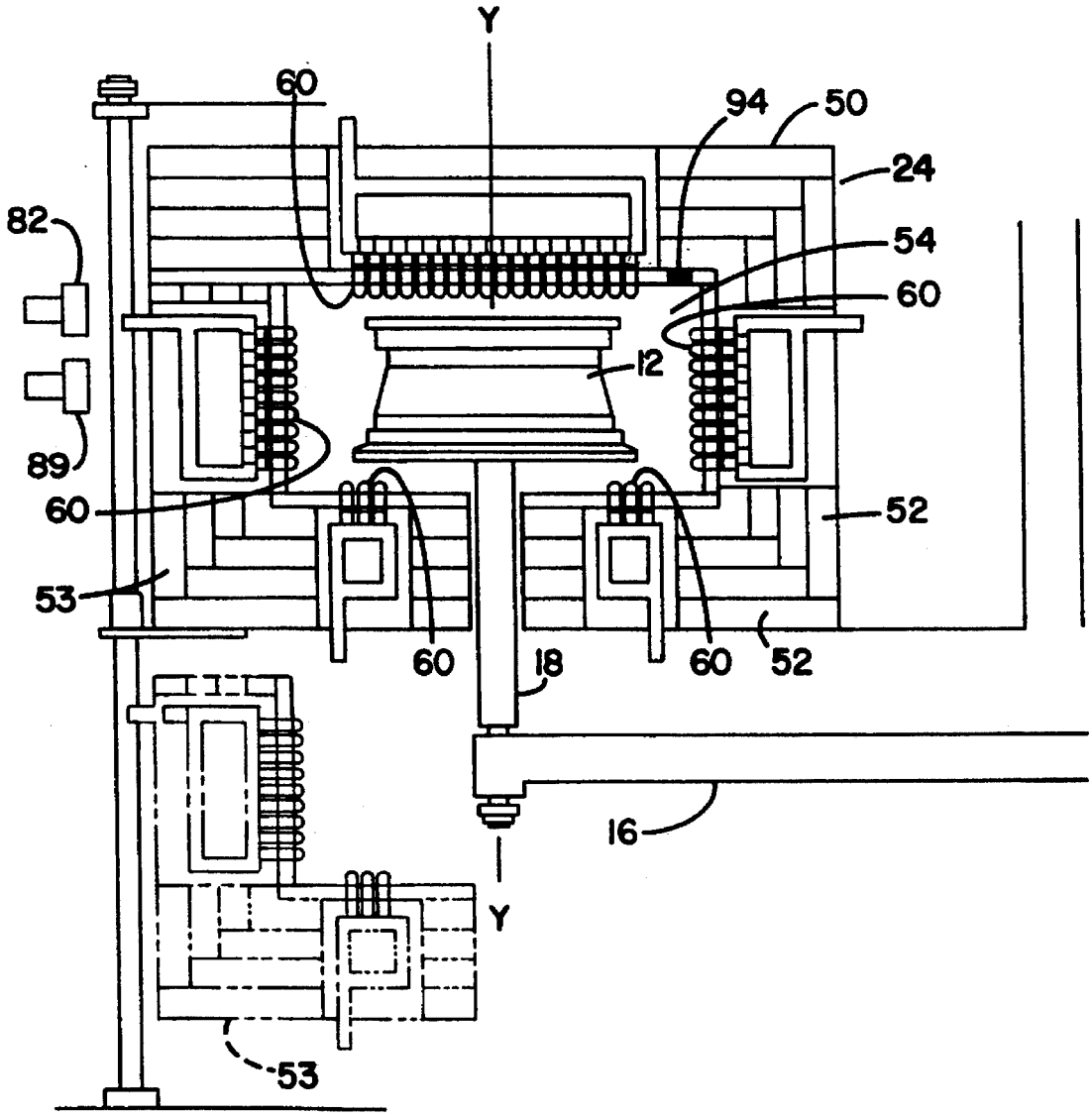
FIG. 2 is a view taken along line 2—2 of FIG. 1.

Each of the heating stations 22–26 and 28–31 include various heating elements. Station 24 is shown in FIG. 2 in cross section. It will be appreciated that all stations 22–26 and 28–31 are similar in configuration to station 24. As shown in FIG. 2, station 24 includes a top refractory wall 50, a reversed L-shaped refractory inner wall 52 and an L-shaped refractory outer wall 53. The walls 50,52,53 cooperate to define an enclosed heat treating chamber 54. The chambers of each of the stations 22–26 and 28–31 are contiguous such that a part 12 passes from chamber to chamber of contiguous stations as the indexing arm 16 rotates about axis X—X. As shown in phantom lines in FIG. 2, L-shaped outer wall 53 may lower to expose the interior of chamber 54.

A plurality of high intensity infrared heat treating lamps 60 are carried on the inner surfaces of the various walls 50,52,53. In a preferred embodiment, the infrared lamps are so-called T-3 lamps which can be heated to temperatures of about 4,500° F. in response to current flow through the lamps.

Station 21 is open to access and is a load point by which a part 12 may be loaded onto a spindle 18 with the part then moved to station 22,23, and so forth through station 26 and to station 27. Station 27 is an access point by which a part 12 may be removed from a spindle 18 and placed in a quench tank 70 and subsequently placed on a take-away conveyor 72. Optionally, the part 12 may be left on the spindle 18 and passed to station 28 where it is then passed in turn, through heat treatment stations 28–31. Station 32 is an unload station which is open to access such that an operator may remove a part 12 from spindle 18 and place the part 12 in a quench tank 77 and subsequently place the quenched part 12 on a take-away conveyor 76. Accordingly, a part 12 is loaded at station 21 and then, upon rotation of the indexing drive 14, positioned in station 22 and held in station 22 for a desired period of time. The part 12 then moves to station 23,24 and so on.

In the preferred embodiment, stations 22,26 constitute a heat treating station for elevating the temperature of the part 12 to a desired heat treatment temperature (for example about 1000° F.). Stations 28,31 collectively are an aging stations for soaking the heat treated part 12 at a temperature of about 400° F.

As will become more apparent, it is desirable to monitor the temperature of the part 12 in each station 21–26 and 28–31. In the preferred embodiment, a plurality of optical pyrometers 80,82,89 are provided to monitor the temperature of the part 12. For an example, an initial pyrometer 80 is provided in station 21 positioned to be directed at a part 12 carried on a spindle 18 at rest in station 21. A plurality of first and second optical pyrometers 82–89 are provided in each of stations 22–26 and 28–31. Upper pyrometers 82 are directed toward the location of a part 12 at rest within the station. Pyrometers 89 are directed to the chamber 54 to measure background temperature within the chamber.

The use of optical pyrometers is attributed to the difficulty of placing a thermocouple on the part 12 since the part is moving throughout the carousel 13 and is rotating on a spindle 18. Accordingly, optical pyrometers are utilized to measure the temperature of the part 12.

The use of optical pyrometers in measuring the temperature of aluminum presents significant problems. For example, the aluminum is highly reflective. Also, the background temperature (i.e., the temperature of the lamps and reflection and emission off of the refractory material within each of the stations) is high. These factors cooperate in providing a read out from the optical pyrometers which is inaccurate. Applicants utilize both pyrometers 82 and 89 as well as empirically derived evidence to compensate for known errors to provide a true temperature of a part 12 within the given chamber.

Specifically, through empirical studies, Applicants have noted that the true temperature of the part 12 during the heat up phase within a station varies from a temperature reading of optical pyrometer 82 alone (i.e., the apparent temperature). The amount of variation is found to vary with both the reading off of the background optical pyrometer 89, the part optical pyrometer 82, a thermocouple 94 placed within the refractory insulation of each station and the current and voltage applied to the lamps 60 in the station.

Figure 4:
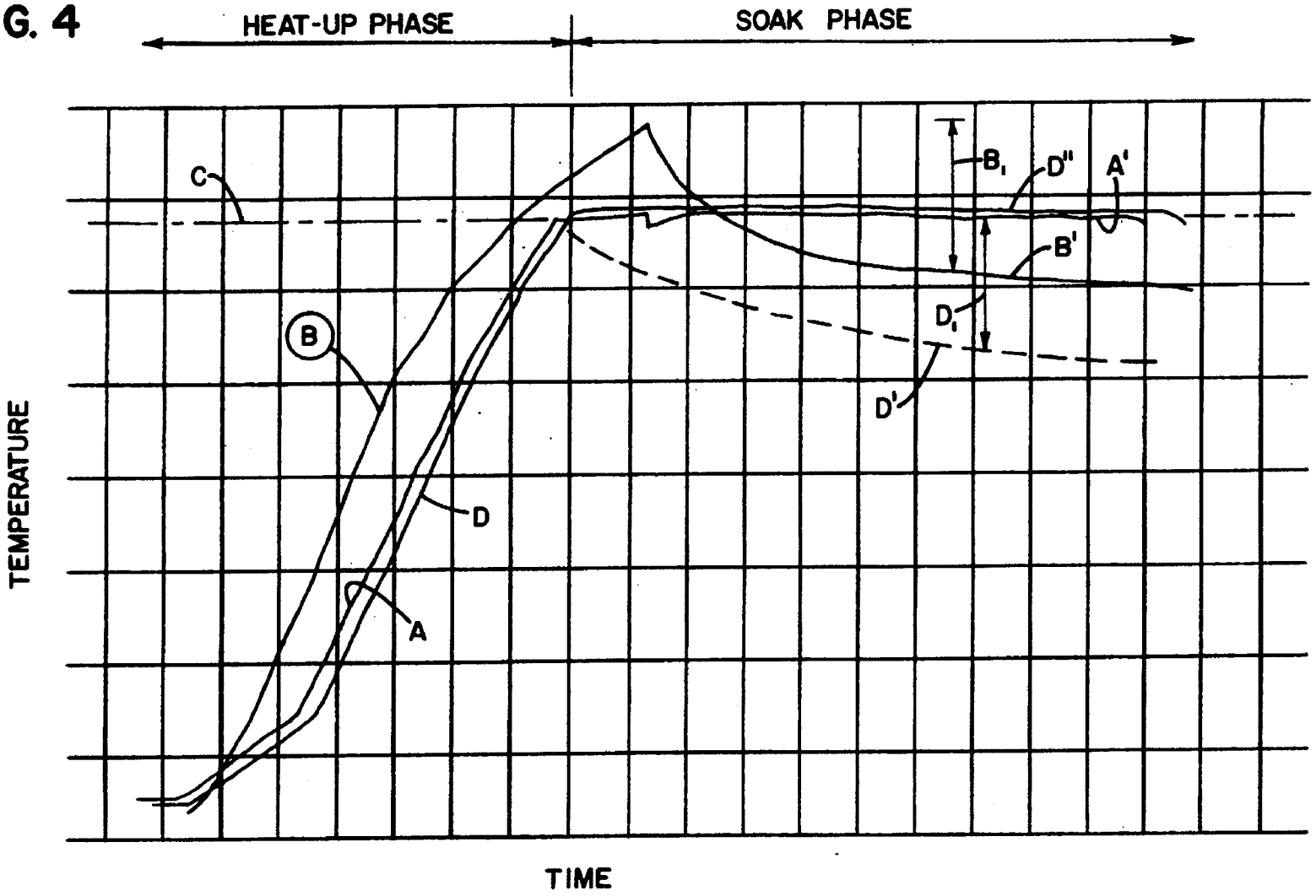
FIG. 4 is a graph showing representative readings of such a system.

FIG. 4 is a graph showing the relation between the true temperature of the part 12 and the readings off of the part optical pyrometer 82. As shown, the true temperature (line A) of the part 12 (measured from a thermocouple in a test application) during the heat up phase of the lamps 60 increases but lags behind the temperature read off of the background optical pyrometer 89 (line B). Also, the apparent temperature as measured by part pyrometer 82 similarly lags (as shown in line D). When the desired temperature (line C) of the part 12 is attained and the lamps 60 are turned off or phased back, the optical pyrometers 82,89 will note and sense the loss of energy to the lamps (indicated by the decaying line B'). Accordingly, the optical pyrometers would falsely read a decrease in temperature of the part. The decay in intensity of lamps 60 as measured by background pyrometer 89 is shown in FIG. 4 as line B'. The part pyrometer 82 also senses the loss in energy and, if uncorrected, would report a false decay in the temperature of the part 12. The false decay is shown as line D'. Therefore, during the decay phase of the lamps 60, the amount of the decay (for example distance $B_1$) is added back to the apparent temperature of the part 12 (illustrated as-distance $D_1$) to give an adjusted reading (line D") indicative of the true temperature (line A') of the part.

It will be appreciated that the foregoing procedure for compensating for optical pyrometers results from the use of optical pyrometers with highly reflective aluminum alloys. Placement of a thermocouple on the part directly measures the temperature of each part which would result in avoiding the need for compensating for inaccuracies in the optical pyrometer readings. While such a temperature sensing is not utilized in a preferred embodiment (due to the difficulty of attaching a thermocouple to moving and rotating parts 12) it will be appreciated that such a measurement technique is contemplated to be within the scope of the present invention.

Figure 3:
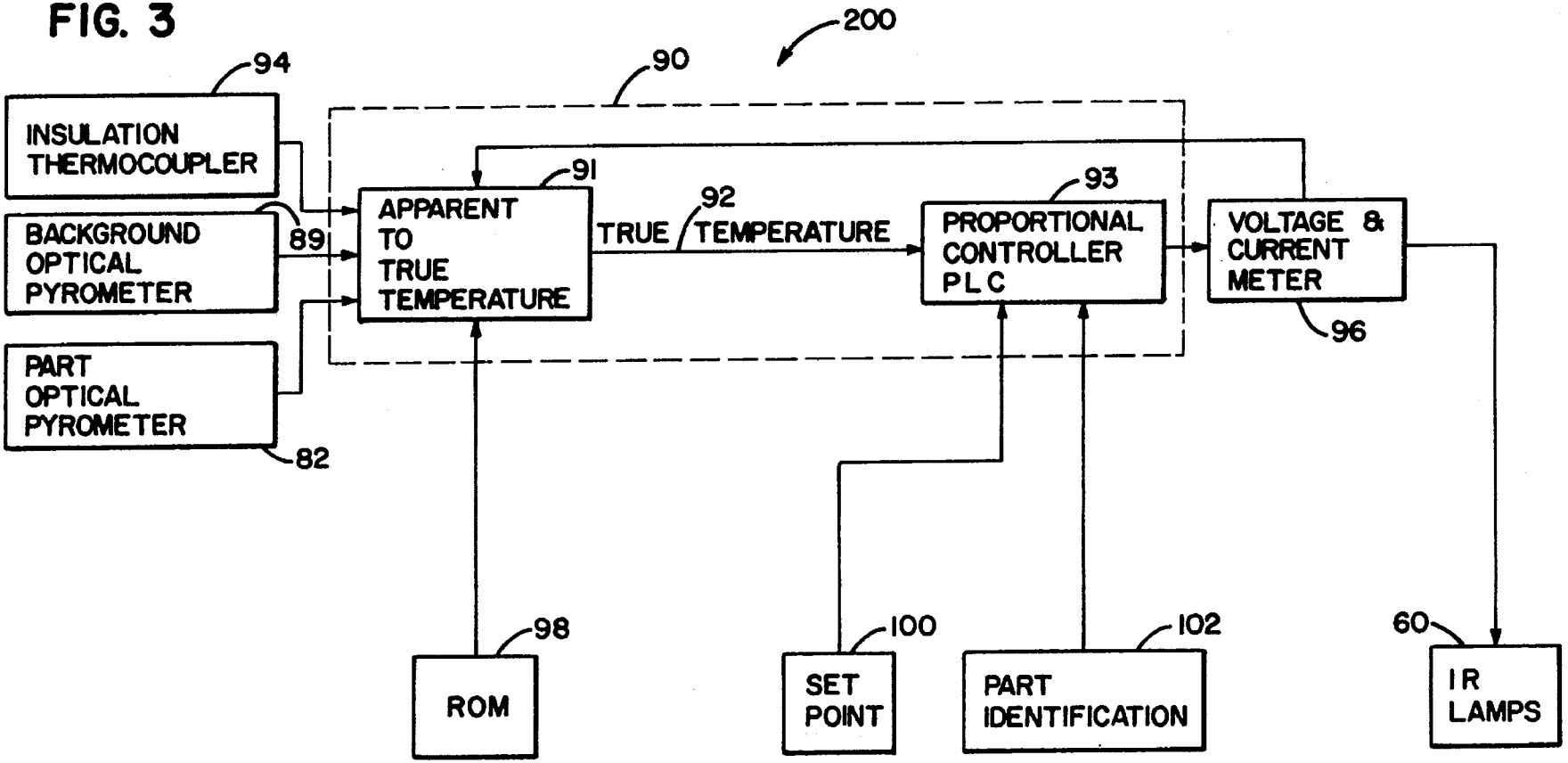
FIG. 3 is a schematic representation of a control system for the apparatus of FIG. 1.

FIG. 3 shows a control system 200 for controlling the intensity of the lamps 60 in each of the stations. As shown, the controller 90 includes software 91 for calculating a true temperature which is sent as an output 92 to a proportional controller 93 for controlling the intensity of the infrared lamps 60. The input to software 91 includes the measurement from the insulation thermocouple 94, the background optical pyrometer 89 and the part optical pyrometer 82. Also, a volt and current meter 96 measures the voltage and current to the lamps 60 and provides the measured voltage and current as input to the software 91. Finally, the software 91 uses memory 98 which includes the empirical data for converting apparent temperatures measured from the optical pyrometers to the true temperature of the parts. The proportional controller 93 accepts as inputs the true temperature 92 as well as a set point 100 or desired temperature of the part 12 and part identification 102 which would include such identifying factors as the mass of the part and its emissivity.

The proportional controller 93 may also be fed a proportional band or proportional band may be preset within the controller 93. The proportional controller then controls the intensity of the lamps based on the inputs. As is known in proportional control, if the true temperature 92 of the part is below the proportional band, the lamps 60 are at full intensity. If the true temperature 92 is above the proportional band, the lamps 60 are at full off. If the true temperature is within the proportional band, the intensity of the lamps 60 is varied. It will be appreciated by those skilled in the art that proportional control as thus described performs no part of this invention per se. Proportional control is more fully described in the commonly assigned U.S. Pat. No. 5,050,232.

With the apparatus as thus described, each part 12 may be separately heat treated. A part 12 is placed in the heat treating station. In the heat treating station (stations 22–26), the part 12 is heated to 1000° F. and maintained at that temperature for about 2 to 2.5 minutes. The heat treated part can then be removed at station 27 and quenched. Following quenching the part 12 may be either placed on conveyor 72 or submitted to the aging station (stations 28–31) where it is heated to about 400° F. to 450° F. and held at that temperature for about 2 to 2.5 minutes. The aged part 12 is then removed at station 32 and quenched in tank 77 and placed on a take-away conveyor 76.

The stations 22–23 cooperate. Namely, the station 23 accepts station 22's output temperature and inputs the temperature for station 23. Stations 28–31 are closed loop controlled with each station, comprising an independent heat treating station.

Having described the structure and operation of the present invention, benefits of the present invention in comparison to prior art heat treatment techniques can be appreciated. In a typical heat treating system, a part that is to be heat treated arrives at the heat treat facility directly from a casting operation. Such a part may have a wide variety of temperatures. For example, the temperature of such a part may be anywhere from 600° F. to 750° F. This is particularly true in the present invention where the part arise from a casting operation. For example, if the part handler misses one of the indexing steps, the part may be in ambient temperature for 4 to 5 minutes which effects the temperature at which it enters the first station. Accordingly, the first station is primarily designed to stabilize the temperature of the part to be within a definable and controllable range of temperatures. A secondary function of the first station is to start the part in the heat treating process of the present invention.

With the teachings of the present invention, one skilled in the art will recognize the importance of a plurality of heat treating stations. As described, a part moves from one station to another in an indexing fashion with the part permitted to dwell in a station for a requisite period of time. As a result, at each station, the part enters with a known temperature (or actual temperature which varies from a known temperature by a predescribed minimum tolerance). Within the station, the part is heated over a relatively narrow range of temperatures. With a narrow range of heat treating within a station and with a narrow range of tolerance for admission to a station, accurate closed-loop control of temperature within a station is more readily attainable. Accordingly, the succession of indexed, multiple, closed-loop controlled stations are very important to the present invention because they permit the part to be examined and treated in a closed loop fashion within a fairly narrow range of temperatures.

Applicants have found that the use of proportional control permits heat treatment of aluminum parts through direct contact with infrared energy. Applicants can achieve a heat treating and aging process that consumes a total of about 4 to 5 minutes of hold time and a total cycle time (which includes hold time and heat-up time) of about 10 minutes. This can be compared with prior art heat treatment which required up to 6 hours for heat treating and up to 12 hours for aging. Also, each part is separately heat treated to uniform temperatures. This results in reduced rejections of parts. Also, a metallurgical history can be made of each part.

In the foregoing description, Applicant has shown an embodiment which includes a heat treating station followed by an aging station. It will be understood and appreciated by those skilled in the art that the present invention can be practiced without use of the aging station and simply use a plurality of stations to heat treat a part according to the teachings of the present invention.

It has been shown how the objects of the invention have been attained in a preferred manner, however, modifications and equivalents of the disclosed concepts, such as those that readily occur to one skilled in the art are intended to be included in the scope of the invention.

What is claimed is:

1. An apparatus for metallurgically heat treating a plurality of discreet, individually movable aluminum alloy parts, said apparatus comprising a plurality of successive stations for heat treating said parts, said plurality of stations arranged in a line of travel with means for one of said parts in each of said stations to be heat treated with direct radiation from at least one infrared radiation lamp until said part attains a final desired state of metallurgical heat treatment after heat treatment in said stations, means for placing and holding said part in one of said plurality of stations and heat treating said part in said one of said plurality of stations with a first infrared radiation intensity independent of an infrared radiation intensity in others of said plurality of stations, said first infrared radiation intensity selected, at least in part; in response to a measured initial temperature of said part prior to said part being heat treated in said first station and means for holding said part substantially stationary relative to said line of travel in said first station during said heat treatment for said part to be heated by said first infrared radiation intensity until a temperature of said part is elevated to a temperature greater than said initial temperature and for said part to at least partially attain said desired final state of metallurgical heat treatment, means for moving said part along said line of travel to a second one of said plurality of stations and holding said part substantially stationary relative to said line of travel in said second one of said plurality of stations with a second infrared radiation intensity independent of an infrared radiation intensity in others of said plurality of stations.

2. An apparatus according to claim 1 comprising means for monitoring a temperature of said part during said heat treatment.

3. An apparatus according to claim 2 wherein said source is an infrared radiation source of controllable intensity, said apparatus including means for varying said intensity in response to a temperature monitored during said monitoring step.

4. An apparatus according to claim 4 comprising a proportional controller to heat treat said part to a desired set temperature.

5. An apparatus according to claim 4 wherein said proportional controller includes means for defining a proportional band surrounding said set point with said intensity of said lamps at substantially full intensity when said measured temperature is lower than said band and with said intensity at a variable reduced intensity when said measured temperature is within said band.

6. An apparatus according to claim 1 wherein said lamp is a T-3 lamp.

7. An apparatus according to claim 1 comprising means for moving said part relative to said lamp while maintaining said part stationary relative to said line of travel for uniform heat treatment of said part.

8. An apparatus according to claim 2 wherein said monitoring is provided utilizing an optical pyrometer.

9. An apparatus according to claim 8 comprising means for modifying an output of said optical pyrometer in response to a predetermined algorithm to derive an approximate true temperature of said part.

10. An apparatus for heat treating a plurality of discreet, individually movable parts by heating said parts with direct radiation from a source of infrared radiation until said parts attain a desired state of heat treatment, said apparatus comprising a plurality of stations arranged in a line of travel, said plurality including at least a first station and at least a second station with each of said first and second stations having separately and independently controllable infrared radiation generating lamps and said first and second stations mutually isolated from one another, means for moving a first of said parts along said line of travel into said first station and holding said first part substantially stationary relative to said line of travel in said first station while heat treating said first part within said first station with a first infrared radiation intensity controlled independent of a second radiation intensity in said second station and simultaneously heat treating a second radiation intensity and while holding said second of said parts in said second station for a period of time equal to a time said first part is held in said first station, means for continuing heat treating said first and second parts for a substantially equal period of time and subsequently moving said second part along said line of travel from said second station and moving said first part along said line of travel directly to said second station and moving a third part along said line of travel into said first station and means for holding said first and third parts substantially stationary relative to said line of travel in said second and first stations, respectively, while heat treating said first part within said second station with a second infrared radiation intensity controlled independent of a radiation intensity in said first station heating said third part, means for heat treating said first and third parts in said second and first stations for a substantially equal period of time.

11. An apparatus according to claim 10 comprising means for controlling an intensity of radiation within each of said stations by monitoring a temperature of said part within each of said stations and separately controlling said intensity in each station.

12. An apparatus according to claim 10 wherein said plurality of stations comprise a heat treating group for heat treating said part to a desired state of metallurgical properties and an aging group including a subsequent plurality of heat treating stations and aging said part in said subsequent plurality of stations subsequent to said heat treating group;

said apparatus including means for heat treating said part in said heat treat group until said part attains said desired state of metallurgical aging properties and subsequently said part in said aging group.

13. An apparatus according to claim 12 comprising means for quenching said part subsequent to said heat treating group and prior to said aging group.

14. An apparatus according to claim 10 comprising means for monitoring a temperature of said part during said heat treatment.

15. An apparatus according to claim 14 wherein said source is an infrared radiation source of controllable intensity, said apparatus including means for varying said intensity in response to a temperature monitored during said monitoring step.

16. An apparatus according to claim 15 wherein said intensity is controlled through a proportional controller to heat treat said part to a desired set temperature.

17. An apparatus according to claim 16 wherein said proportional controller includes means for defining a proportional band surrounding said set point with said intensity of said lamps at substantially full intensity when said measured temperature is lower than said band and with said intensity at a variable reduced intensity when said measured temperature is within said band.

18. An apparatus according to claim 10 wherein said source includes a plurality of high intensity infrared lamps.

19. An apparatus according to claim 18 wherein said lamps are T-3 lamps.

20. An apparatus according to claim 10 comprising means for moving said part relative to said source for uniformly heat treatment of said part.

21. An apparatus according to claim 14 wherein said monitoring is provided utilizing an optical pyrometer.

22. An apparatus according to claim 21 comprising means for modifying an output of said optical pyrometer in response to predetermined algorithms to derive an approximate true temperature of said part.

23. An apparatus according to claim 1 comprising means for moving said part in a path of travel which is at least an arc of a circle as said part moves between said plurality of successive stations.

24. An apparatus according to claim 10 comprising means for moving said part in a path of travel which is at least an arc of a circle as said part moves between said plurality of stations.

25. An apparatus for heating treating a plurality of discreet, individually movable parts, said apparatus comprising:

a plurality of heat treating stations including at least a first station and a subsequent station arranged in a line of travel;

means for measuring an actual temperature of a first one of said plurality of discreet parts;

means for admitting said first one to said first station and holding substantially stationary relative to said line of travel said first one in said first station for a first residence time;

means for heat treating said first one in said first station during said first residence time with infrared radiation emitted from infrared lamps having an intensity selected in response to said measured actual temperature of said first one to elevate a temperature of said first part for said first part to at least partially attain a desired state of heat treatment;

means for measuring an actual temperature of a second one of said plurality of discreet parts;

means for moving said first one along said line of travel to said subsequent station after said first residence time and admitting said second one to said first station;

means for holding said first one substantially stationary relative to said line of travel in said subsequent station for a second residence time and holding said second substantially stationary relative to said line of travel one in said first station for said second residence time;

means for heat treating said first one in said subsequent station during said second residence time with infrared radiation from infrared lamps within said second station with said second infrared lamps having an intensity selected in response to an amount of heat treatment of said first one in said first station; and means for heat treating said second one in said first station during said second residence time with infrared radiation from said first infrared lamps having an intensity selected in response to said measured actual temperature of said second one to elevate a temperature of said second part for said second part to at least partially attain a desired state of heat treatment.

26. An apparatus according to claim 25 comprising means for measuring said actual temperature of said first one within said first station during said heat treatment and varying said intensity of said lamps for said first one to obtain a desired exit temperature from said first station at an end of said first residence time.

27. An apparatus according to claim 25 comprising means for measuring said temperature of said first one within said subsequent station during said second residence time and varying said intensity of said second lamps in response to said measured temperature for said first one in said subsequent station to be heat treated to a predetermined exit temperature at said second residence time.

28. An apparatus according to claim 1 comprising means for rotating at least any one of said parts while holding said any one in at least any one of said plurality of stations.

29. An apparatus according to claim 10 comprising means for rotating at least any one of said parts while holding said any one in at least any one of said plurality of stations.

30. An apparatus according to claim 25 comprising means for rotating at least any one of said parts while holding said any one in at least any one of said plurality of stations.

* * * * *

UNITED STATES PATENT AND TRADEMARK OFFICE
CERTIFICATE OF CORRECTION

PATENT NO. : 5,485,985

DATED : January 23, 1996

INVENTOR(S) : Eppeland, et al.

It is certified that error appears in the above-identified patent and that said Letters Patent is hereby corrected as shown below:

Column 1, line 5, "NO." should read --No.--;

Column 2, line 58, "Plurality" should read --plurality--;

Column 5, line 35, "treat" should read --treating--;

Column 6, claim 1, line 36, ";" should read --,--;

Column 7, claim 12, line 59, "treat" should read --treating--;

Signed and Sealed this

Third Day of September, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,485,985

DATED : January 23, 1996

INVENTOR(S) : John R. Eppeland, et al.

It is certified that error appears in the above-indentified patent and that said Letters Patent is hereby corrected as shown below:

Column 8, claim 25, line 63, "one" should be inserted after the second occurrence of the word "second".

Column 8, claim 25, line 65, before "in", delete "one".

Signed and Sealed this

Twenty-first Day of January, 1997

*Attest:*

Bruce Lehman

BRUCE LEHMAN

*Attesting Officer*

*Commissioner of Patents and Trademarks*